US009681690B2

(12) United States Patent
Scemla

(10) Patent No.: US 9,681,690 B2
(45) Date of Patent: Jun. 20, 2017

(54) SLEEVE ASSEMBLY FOR A GARMENT AND METHOD OF MANUFACTURE

(71) Applicant: Sebastien Scemla, Miami, FL (US)

(72) Inventor: Sebastien Scemla, Miami, FL (US)

( * ) Notice: Subject to any disclaimer, the term of this patent is extended or adjusted under 35 U.S.C. 154(b) by 0 days.

(21) Appl. No.: 15/402,294

(22) Filed: Jan. 10, 2017

(65) Prior Publication Data

US 2017/0112198 A1 Apr. 27, 2017

Related U.S. Application Data

(62) Division of application No. 14/184,767, filed on Feb. 20, 2014, now abandoned.

(51) Int. Cl.

| | |
|---|---|
| ***A41D 27/10*** | (2006.01) |
| ***A41B 1/08*** | (2006.01) |
| ***A41D 1/00*** | (2006.01) |

(52) U.S. Cl.

CPC ..... *A41B 1/08* (2013.01); *A41D 1/00* (2013.01); *A41D 27/10* (2013.01)

(58) Field of Classification Search

CPC ..... A41D 27/10; A41B 7/00; A41B 7/02

See application file for complete search history.

(56) References Cited

U.S. PATENT DOCUMENTS

| | | | |
|---|---|---|---|
| 170,641 | A | 11/1875 | Perego |
| 306,417 | A | 10/1884 | Moseley |
| 727,935 | A | 5/1903 | Grave et al. |
| 811,662 | A | 2/1906 | Puryear |
| 1,052,158 | A | 2/1913 | Martin |
| 1,116,307 | A | 11/1914 | Lynch |
| 1,199,950 | A | 10/1916 | Weary |
| 1,266,182 | A | 5/1918 | Vidette |
| 2,274,980 | A | 3/1942 | Geist |
| 2,328,137 | A | 8/1943 | Goldberg |
| D207,090 | S | 3/1967 | Kay |
| 6,148,445 | A | 11/2000 | Spruill |
| 2012/0233738 | A1 | 9/2012 | Blauer et al. |

OTHER PUBLICATIONS

Zovi Blue Regular Fit Shirt With Roll Up Sleeves—Zovi Size Store Mens Shirts; online store; Oct. 25, 2012; http://zovi.com/blue-regular-fit-shirt-with-roll-up-sleeves-S126SRM04503.

Classic Twill Shirt in Two Tone Colors > Mens Clothing > Shirts at Scotch & Soda; online store; Jan. 3, 2014, http://webstore-us.scotch-soda.com/men/shirts/classic-twill-shirt-in-two-tone-colours/13040820034.html.

*Primary Examiner* — Richale Quinn

(74) *Attorney, Agent, or Firm* — Davidoff Hutcher & Citron LLP

(57) ABSTRACT

Method of manufacturing a sleeve assembly for a shirt including a sleeve adapted to receive an arm and a cuff. An outer surface of the cuff is connected to a lower edge region of the sleeve at a location between upper and lower edges of the cuff to define a cuff extension portion. The sleeve assembly is foldable from the unfolded condition to a first folded condition about the location at which the cuff is connected to the sleeve. The sleeve assembly is foldable from the first folded condition to a second folded condition about a location at which a free edge of the cuff abuts the sleeve to place a portion of the sleeve on an outer side of the sleeve assembly and an outer surface of the cuff extension portion between two portions of the sleeve.

6 Claims, 6 Drawing Sheets

SLEEVE ASSEMBLY FOR A GARMENT AND METHOD OF MANUFACTURE

REFERENCE TO PRIOR APPLICATIONS

This application is a continuation of U.S. application Ser. No. 14/184,767, filed Feb. 20, 2014 and allowed Sep. 7, 2016, which is incorporated herein by reference in its entirety.

FIELD OF THE INVENTION

The present invention relates generally to a method for manufacturing a sleeve assembly and incorporating the sleeve assembly into a garment such as a shirt.

BACKGROUND OF THE INVENTION

Shirts that have adjustable length sleeves are known in the art. For example, U.S. Pat. No. 6,148,445 describes an awning sleeve shirt having a tabbing system that allows sleeves 18, 18A to be retracted up to two distinct positions on the shoulders and releasably attached using tabs 14A, 14B. This athletic shirt is alleged to provide a wearer a greater range-of-motion without the movement of his arms being inhibited by sleeves which might be laden with perspiration. Other examples are described in U.S. Pat. Nos. 170,641, 306,417, 727,935, 811,662, 1,052,158, 1,116,307, 1,199,950, 1,266,182, 2,274,980 and 2,328,137. All of these patents are incorporated by reference herein.

SUMMARY OF THE INVENTION

An object of the invention is to provide a sleeve assembly that provides for multiple folded conditions and thus multiple sleeve lengths.

Another object of the invention is to provide a method for manufacturing a sleeve assembly that provides for multiple folded conditions and thus multiple sleeve lengths.

One embodiment of a sleeve assembly for a garment in accordance with the invention includes a sleeve adapted to receive an arm and having an inner surface and an outer surface, and a cuff having an inner surface and an outer surface. The outer surface of the cuff is connected to a lower edge region of the sleeve at a location on the outer surface of the cuff between upper and lower edges of the cuff to thereby define a cuff extension portion between the location at which the outer surface of the cuff is connected to the lower edge region and the upper edge of the cuff. The cuff extension portion is on an inner side of the sleeve assembly when the sleeve assembly is in an unfolded condition, i.e., not visible. The sleeve assembly also includes an attachment device arranged on the inner surface of the sleeve, and a strap fixed at one end region to the inner surface of the sleeve at a location more distant from the lower edge region than the attachment device. The strap extends to the attachment device and is removably coupled thereto. A sleeve placket is usually provided and extends from the lower edge region of the sleeve to a location between the attachment device and the fixed end region of the strap.

Another embodiment of a sleeve assembly for a garment in accordance with the invention includes a sleeve adapted to receive an arm of the wearer and has an inner surface and an outer surface, and a cuff also having an inner surface and an outer surface. The outer surface of the cuff is connected to a lower edge region of the sleeve at a location between upper and lower edges of the cuff to thereby define a cuff extension portion between the location at which the cuff is connected to the lower edge region of the sleeve and the upper edge of the cuff. The cuff extension portion is thus on an inner side of the sleeve assembly when the sleeve assembly is in an unfolded condition.

The sleeve assembly is foldable, at the discretion of the wearer, from the unfolded condition to a first folded condition about the location at which the cuff is connected to the lower edge region of the sleeve to thereby place the outer surface of the cuff against a first portion of an outer surface of the sleeve and the inner surface of the cuff viewable alongside a remaining portion of the outer surface of the sleeve.

Then, the sleeve assembly is, at the discretion of the wearer, foldable from the first folded condition to a second folded condition about a folding location to thereby place a first portion of the inner surface of the sleeve on an outer side of the sleeve assembly, said folding location being the location at which the lower edge of the cuff abuts the sleeve when the sleeve assembly is in the first folded condition. Also, an outer surface of the cuff at the cuff extension portion is visible between the first portion of the inner surface of the sleeve on the outer side of the sleeve assembly and the outer surface of a remaining portion of the sleeve.

Further, the sleeve assembly is, at the discretion of the wearer, foldable from the second folded condition to a third folded condition about a location at which the cuff extension portion abuts the sleeve to thereby place a second portion of the inner surface of the sleeve on the outer side of the sleeve assembly.

For use when the sleeve assembly is in the third folded condition, an attachment device, e.g., a button, is arranged on the second portion of the inner surface of the sleeve and a strap fixed at one end region to a third portion of the inner surface of the sleeve. The strap has a length to enable it to extend around to the button and be removably coupled thereto, e.g., via a slot on the strap. To ease the folding, a sleeve placket may be provided and extends from the lower edge region of the sleeve to a point adjacent to or within the second portion of the inner surface of the sleeve.

A shirt in accordance with the invention would therefore include a shirt front, a shirt back, and two of the sleeve assemblies of any of the above-described embodiments attached to the shirt front and shirt back.

A method for manufacturing a sleeve assembly for a garment includes connecting a cuff to a lower edge region of a sleeve at a location on an outer surface of the cuff between upper and lower edges of the cuff to thereby define a cuff extension portion between the location at which the cuff is connected to the lower edge region and the upper edge of the cuff. The cuff extension portion is on an inner side of the sleeve assembly when the sleeve assembly is in an unfolded condition. The sleeve assembly is foldable from the unfolded condition to the first folded condition as described above.

Then, dimensions of the cuff extension portion are selected and implemented such that when the sleeve assembly is folded from the first folded condition to a second folded condition about a location at which the lower edge of the cuff abuts the sleeve, a first portion of an inner surface of the sleeve is placed on an outer side of the sleeve assembly and an outer surface of the cuff at the cuff extension portion is placed between the first portion of the inner surface of the sleeve on the outer side of the sleeve assembly and a portion of an outer surface of the sleeve. Further, the sleeve assembly is configured to be foldable from the second folded condition to the third folded condition in the manner described above.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
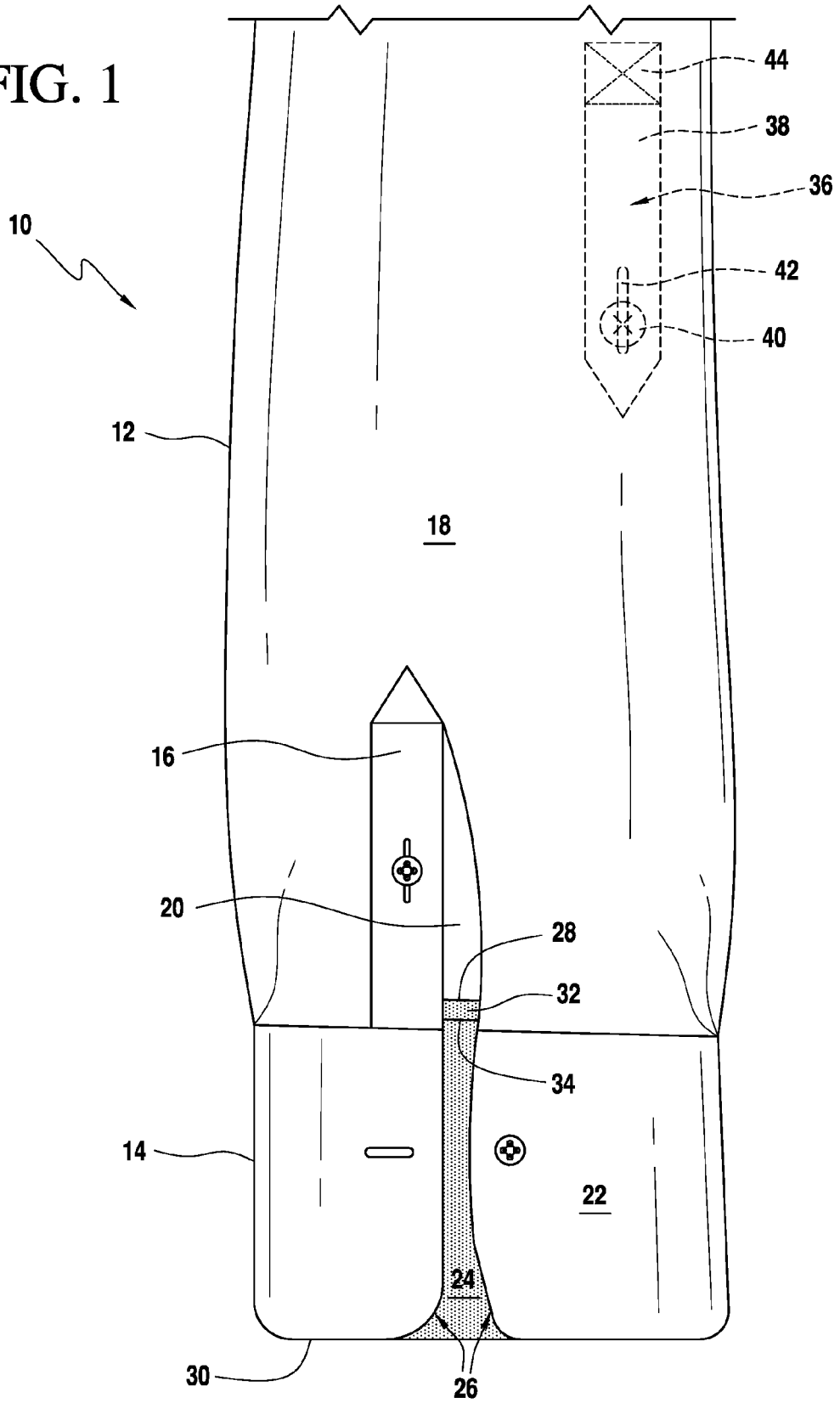
FIG. 1 is a front view of a shirt sleeve assembly in accordance with the invention in an unfolded condition.

Referring to the accompanying drawings wherein the same reference numbers refer to the same or similar elements, FIG. 1 shows a shirt sleeve assembly 10 in accordance with the invention. Sleeve assembly 10 is designed for use in a garment and particularly a shirt, and to this end, to form a shirt, two sleeve assemblies 10 would be attached to opposite sides of a shirt front panel and a shirt back panel (see FIG. 6). Other conventional parts of the shirt would also be provided, as known to those skilled in the art. The sleeve assembly 10 may thus be a unit that is prepared along with other shirt parts, and assembled together at the same time to form the shirt.

Sleeve assembly 10 includes a sleeve 12 adapted to receive an arm of the wearer of the shirt, a cuff 14 connected to a lower edge region of the sleeve 12 and a sleeve placket 16. Sleeve 12 includes an outer surface 18 and an inner surface 20. The outer surface 18 is that surface of the sleeve 12 that is primarily visible when the sleeve 12 is in a fully extended, unfolded condition, as shown in FIG. 1. A small portion of the inner surface 20 is visible seen through the sleeve placket 16.

The cuff 14 also has an outer surface 22 and an inner surface 24. The outer surface 22 is that surface of the cuff 14 that is primarily visible when the cuff 14 is in an unfolded condition, as shown in FIG. 1. A small portion of the inner surface 24 is visible seen through the spaced apart lateral edges 26 of the cuff 14. The inner surface 22 of the cuff 14 and the outer surface 24 of the cuff 14 may be formed of two separate layers of material and may be of different materials, of different colors or bear different designs.

Figure 2:
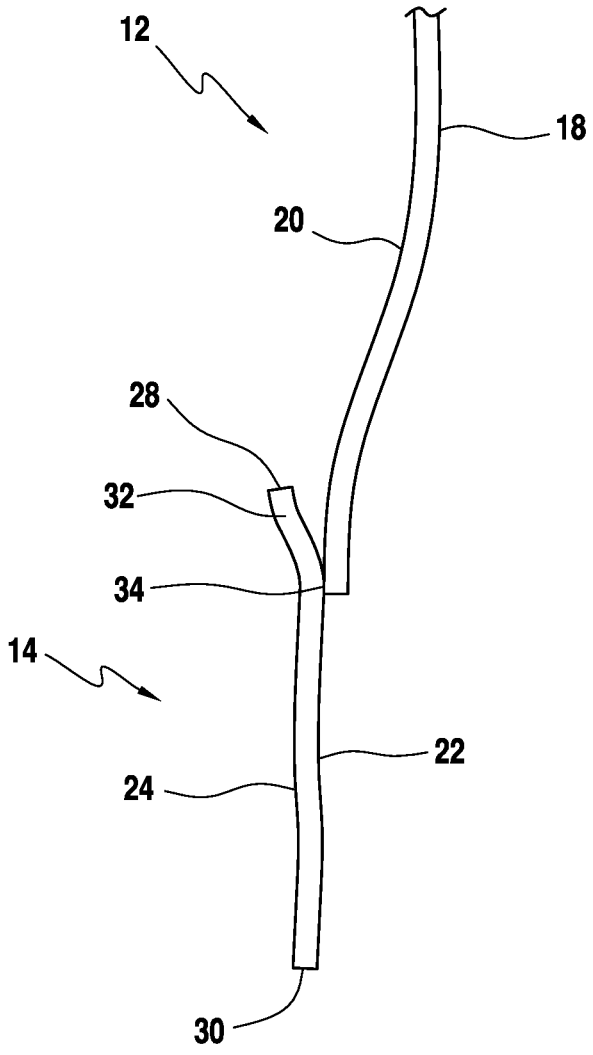
FIG. 2 is an enlarged view of the area where the lower edge region of the sleeve and the cuff are connected of the sleeve assembly shown in FIG. 1.

The manner in which the sleeve 12 and cuff 14 are attached to one another is important to enable advantages of the invention to be obtained. Specifically, the cuff 14 is attached along its outer surface 22 to a lower edge region of the sleeve 12 at a location 34 between an upper edge 28 and a lower edge 30 of the cuff 14 (see FIG. 2). As such, a cuff extension portion 32 is formed between the location 34 at which the outer surface 22 of the cuff 14 is connected to the lower edge region of the sleeve 12 and the upper edge 28 of the cuff 14. The cuff extension portion 32 may thus be considered to be defined by and extend between the upper edge 28 of the cuff 14 and the location 34 at which the cuff 14 is connected to the lower edge region of the sleeve 12.

The sleeve assembly 10 also includes an attachment unit 36. The attachment unit 36 may have several different forms, without deviating from the scope and spirit of the invention. In the illustrated embodiment, the attachment unit 36 is arranged on the inner surface 20 of the sleeve 12 and comprises a strap 38 fixed at one, higher end 44 to the inner surface 20 of the sleeve 12 and a button 40 attached to the inner surface 20 of the sleeve 12 at a distance from the location at which the strap 38 is fixed to enable the strap 38 to extend and removably couple to the button 40 via a slot 42 proximate a lower end of the strap 38. The end 44 of the strap 38 may be fixed by stitching to the inner surface of the sleeve 12. Importantly, the attachment unit 36 is concealed when the sleeve assembly 10 is in the unfolded condition, the first folded condition or the second folded condition.

The sleeve assembly 10 is constructed to provide for different folded conditions in which different visual effects can be obtained, i.e., different parts of the sleeve assembly 10 are visible in the unfolded condition and each of a plurality of folded conditions. By constructing the sleeve assembly 10 and more specifically, providing appropriate dimensions for the sleeve 12 and cuff 14 and attaching them to one another in a specific manner, it is possible to expose different portions of the outer and inner surfaces 18, 20 of the sleeve 12 and the outer and inner surfaces 22, 24 of the cuff 14 as the sleeve assembly 10 is folded from an initially unfolded condition.

FIG. 1 shows the sleeve assembly 10 in an unfolded condition in which the cuff extension portion 32 is on an inner side of the sleeve assembly 10, and slightly or not at all visible through the space between the sleeve placket 16 or the space between the lateral edges 26 of the cuff 14.

Figure 3:
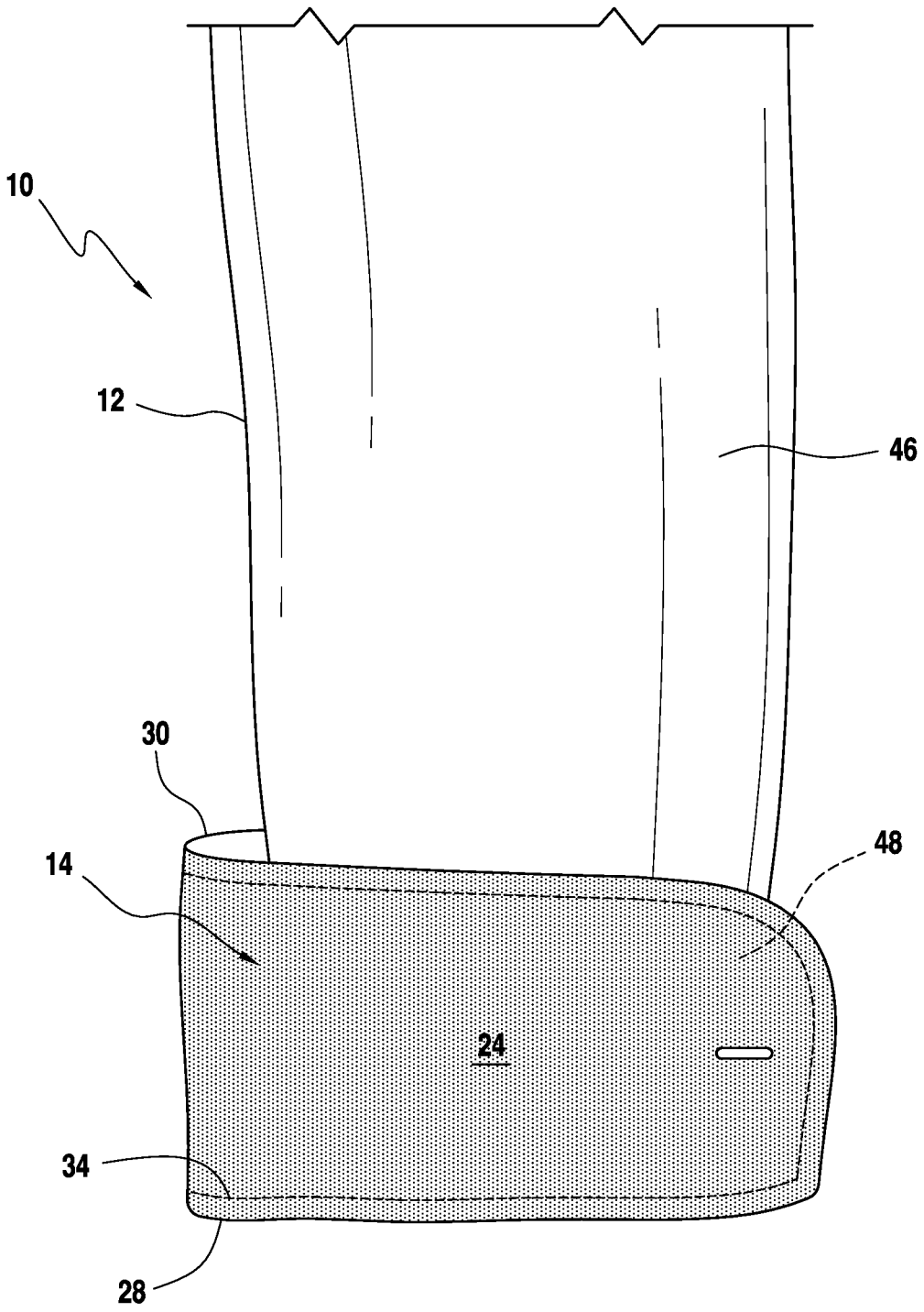
FIG. 3 is a front view of a shirt sleeve assembly in accordance with the invention in a first folded condition.

Referring to FIG. 3, a first folded condition is obtained for the sleeve assembly 10 by folding the sleeve assembly 10 about the location 34 at which the outer surface 22 of the cuff 14 is connected to the lower edge region of the sleeve 12. In this condition, the outer surface 22 of the cuff 14 is mostly against a first portion 48 of the outer surface 18 of the sleeve 12 and the inner surface 24 of the cuff 14 is viewable alongside a remaining portion 46 of the outer surface 18 of the sleeve 12. The outer surface of the cuff 14 at the cuff extension portion 32 is inwardly exposed and not lying against the outer surface of the sleeve 12.

Figure 4:
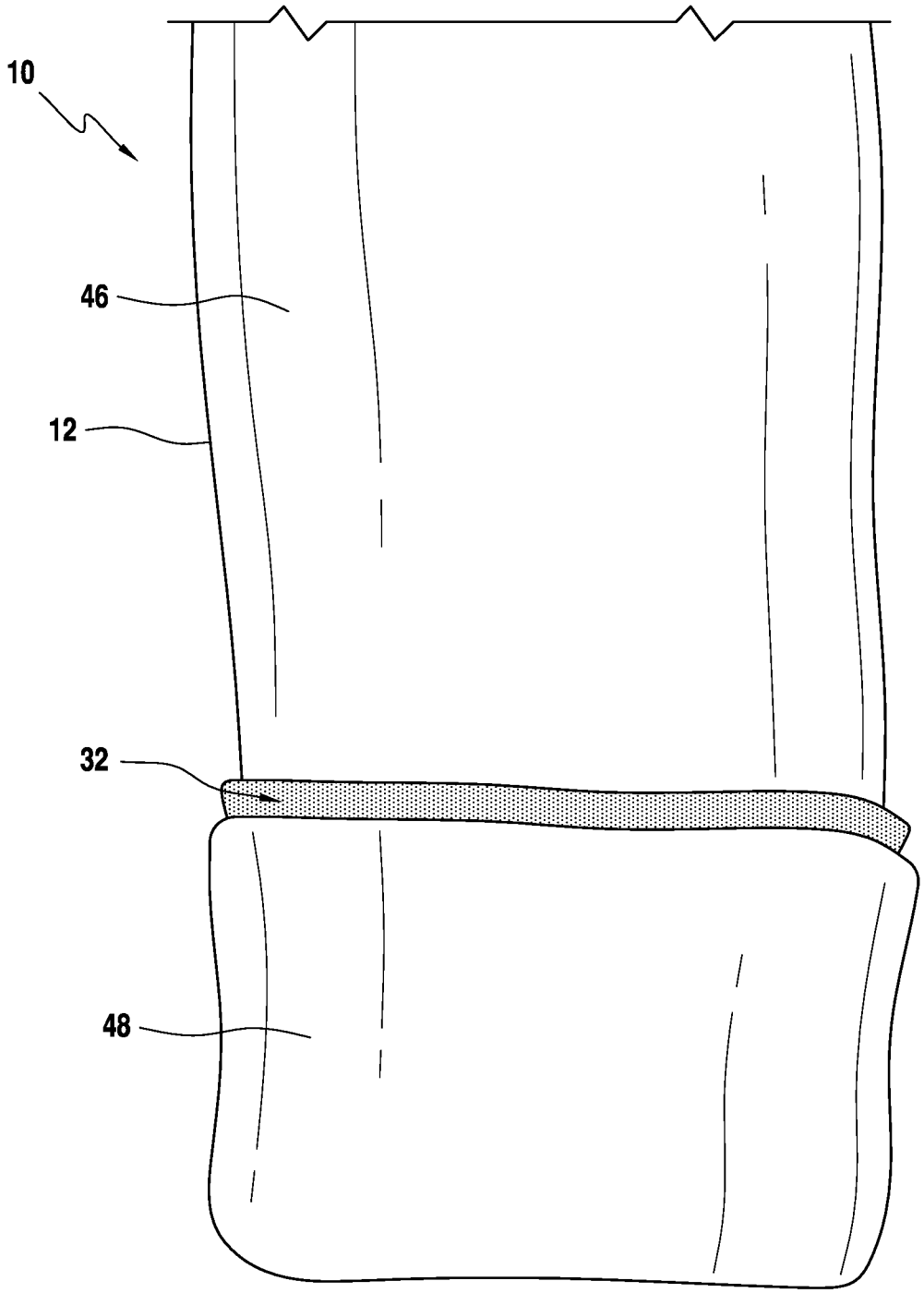
FIG. 4 is a front view of a shirt sleeve assembly in accordance with the invention in a second folded condition.

Referring to FIG. 4, from this first folded condition, the sleeve assembly 10 can be folded into a second folded condition about a location at which the lower edge 30 of the cuff 14 surface abuts the sleeve 12. In this condition, the first portion 48 of the sleeve 12 is placed on an outer side of the sleeve assembly 10 and an outer surface of the cuff 14 at the extension portion 32 is placed between the first portion 48 of the sleeve 12 on the outer side of the sleeve assembly 10 and the remaining portion 46 of the sleeve 12. The cuff 14 has thus been folded twice with the effect that it has been rotated 360° so that its outer surface 22 now again faces outward away from the sleeve 12. Yet, only the small portion of the outer surface 22, that on the cuff extension portion 32, is visible because the remaining part is covered by part of the sleeve 12.

This second folded condition thus causes one side of the cuff extension portion 32 to be visible, and serves as an interruption between two portions of the sleeve 12. When the two portions of the sleeve 12 have the same design, it is possible to form the cuff extension portion 32 with a different design to thereby create a high contrast between the sleeve design and the cuff extension portion design. For example, the sleeve 12 may be formed from a solid, colored material. The cuff extension portion 32 may be formed by a stripped material of two different colors, both of which are different than the color of the sleeve 12. Then, in the second folded condition, the stripped pattern of the cuff extension portion 32 will stand out against a backdrop of the solid material of the sleeve 12.

Figure 5:
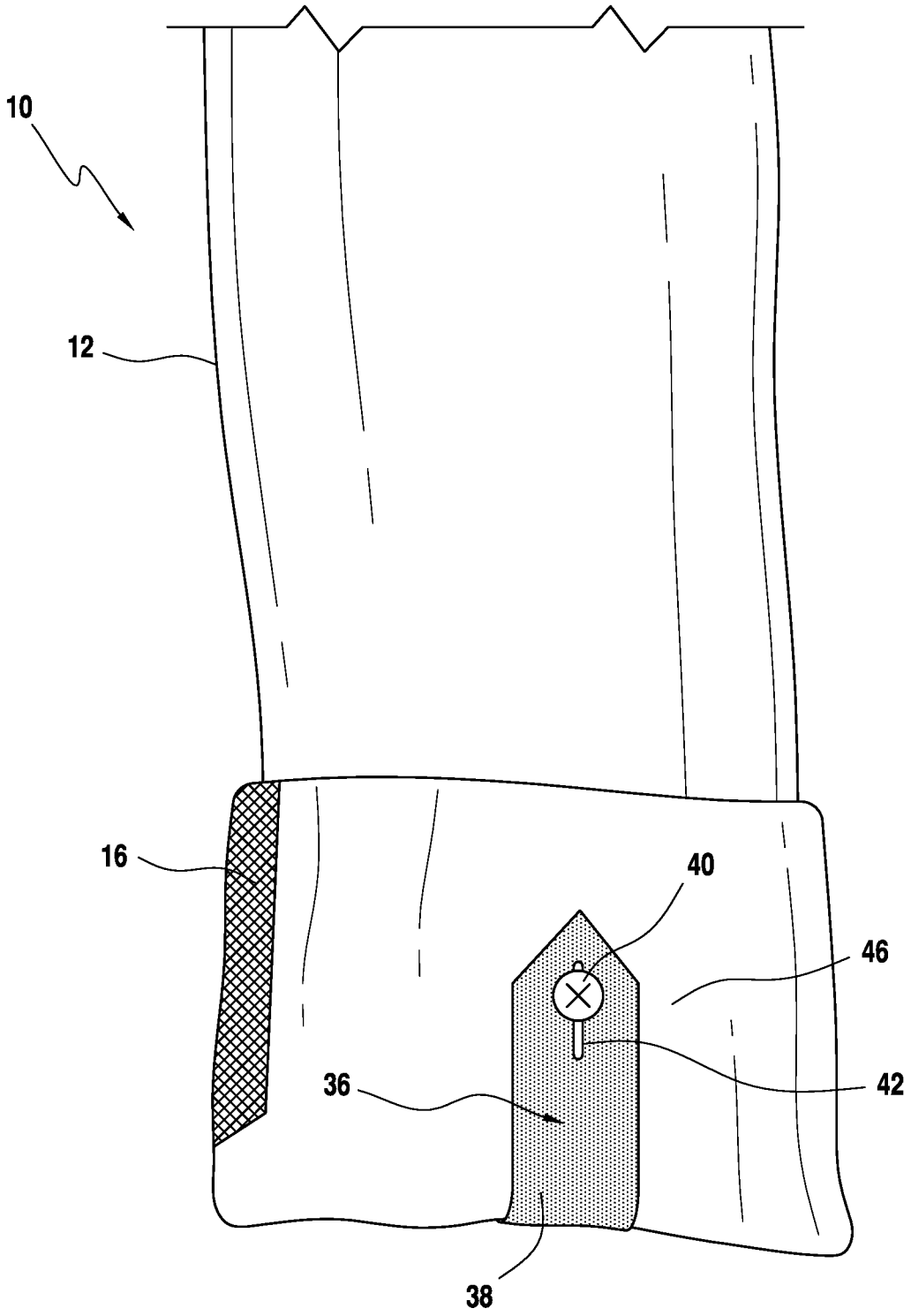
FIG. 5 is a front view of a shirt sleeve assembly in accordance with the invention in a third folded condition wherein the strap and attachment device are exposed.

Referring to FIG. 5, from the second folded condition shown in FIG. 4, it is possible to further fold the sleeve assembly 10 into a third folded condition about a location at which the cuff extension portion 32 abuts the sleeve 12. In this condition, part of the portion 46 of the sleeve 12 is placed on an outer side of the sleeve assembly 10, below a remaining part of portion 46 of the sleeve 12.

In this condition, the strap 38 is exposed. In contrast to in the unfolded and first and second folded conditions of the sleeve assembly 10 when it is on the inner side of the sleeve 12 and thus not visible or exposed. The strap 38 may be attached to the button 40 via the slot 42.

Moreover, in this condition, the upper end of the sleeve placket 16 is visible. That is, the sleeve placket 16 extends from the lower edge region of the sleeve 12 (see FIG. 1) to a point adjacent that portion of the sleeve 12 that will be visible in the third folded condition shown in FIG. 5. Alternatively, the sleeve placket 16 extends to a location between the button 40 and the fixed end region of the strap 38. Different lengths of the sleeve placket 16 are also envisioned as part of the invention.

However, when a portion of the sleeve placket 16 is visible when the sleeve assembly is in its third folded condition, it is possible to coordinate the color and pattern of the sleeve placket 16 with the color and pattern of the strap 38 since both are visible. If the color and pattern of the sleeve placket 16 and the color and pattern of the strap 38 are the same, they will both contrast with the color and pattern of the surrounding sleeve. The color and pattern of the sleeve placket 16 and the color and pattern of the strap 38 may be different, and also different than color and pattern of the sleeve 12. Different color schemes, pattern schemes and different materials as well, are all contemplated for a sleeve assembly 10 for a shirt in accordance with the invention.

When the sleeve assembly 10 is in the third folded condition, the cuff extension portion 32 is not visible. Rather, it has been folded to a position between two portions of the sleeve 12. Thus, the strap 38 does not extend around the cuff extension portion 32 but rather extends along an inner surface of the sleeve 12, along one non-viewable portion adjacent its fixing location and then along a viewable portion adjacent the slot 42.

In the invention therefore, the cuff extension portion 32 is not visible at the same time as the strap 38 is visible. Rather, the cuff extension portion 32 is visible in the second folded condition shown in FIG. 4, but not in the third folded condition shown in FIG. 5, and the strap 38 is visible in the third folded condition shown in FIG. 5, but not in the second folded condition shown in FIG. 4. Thus, the strap 38 is visible in a subsequent fold of the sleeve assembly 10 after the cuff extension portion 32 is visible.

The invention thus differs from prior art shirts, e.g., a Zovi brand shirt sold by Robemall Apparels Pvt. Ltd. (zovi.com), in that in such prior art shirts, the sleeve assembly is folded to simultaneously expose a band of contrasting fabric and a hold-tab. Exposure of the hold-up tab occurs simultaneously with the exposure of the band of fabric of contrasting color and thus not sequential thereto as in the invention.

The invention also encompasses a method for manufacturing a sleeve assembly for a garment, such as a shirt, and then manufacturing a shirt. In the method, a cuff 14 is connected to a lower edge region of a sleeve 12 at a location on an outer surface 22 of the cuff 14 between upper and lower edges 28, 30 of the cuff 14 to thereby define a cuff extension portion 32 between the location 34 at which the outer surface of the cuff 14 is connected to the lower edge region of the sleeve 12 and the upper edge of the cuff 14. The cuff extension portion 32 is on an inner side of the sleeve assembly 10 when the sleeve assembly 10 is in an unfolded or non-folded condition (see FIGS. 1 and 2). The outer surface 22 of the cuff at the cuff extension portion 32 faces an inner surface of the sleeve 12 (see FIG. 2), while an inner surface of the cuff 14 at the extension portion 32 substantially faces itself when the sleeve assembly 10 is in a circular configuration as conventionally worn. The sleeve assembly 10 is foldable to a first folded condition about the location 34 at which the outer surface of the cuff is connected to the lower edge region to thereby place the outer surface of the cuff on an outer side of the sleeve assembly with the lower edge of the cuff 14 above the upper edge of the cuff 14 (from the condition shown in FIG. 1 to the condition shown in FIG. 3).

Also, the method entails selecting dimensions of the cuff extension portion 32 such that when the sleeve assembly 10 is folded from the first folded condition to a second folded condition about a location at which the lower edge of the cuff 14 abuts the sleeve 12, a first portion of the sleeve 12 is placed on an outer side of the sleeve assembly 10 and an outer surface of the cuff extension portion 32 is placed between the first portion of the sleeve 12 on the outer side of the sleeve assembly 10 and a remaining portion of an outer surface of the sleeve 12.

Manufactured in this manner, the sleeve assembly 10 can be folded from the unfolded condition shown in FIG. 1 to the first folded condition shown in FIG. 3, and optionally therefrom to the second folded condition shown in FIG. 4.

Additional manufacture of the sleeve assembly 10 may enable the sleeve assembly 10 to be folded from the second folded condition to a third folded condition, shown in FIG. 5, about a location at which the cuff extension portion 32 abuts the sleeve 12 to thereby place a second portion of the inner surface of the sleeve 12 on the outer side of the sleeve assembly 10.

To aid in maintaining the sleeve assembly in the third folded condition, the manufacture of the sleeve assembly optionally includes arranging an attachment device (button 40) on the second portion of the inner surface of the sleeve 12, fixing the strap 38 at one end region to a third portion of the inner surface of the sleeve 12, and selecting dimensions of the strap 38 to enable the strap to extend around to the button 40 and be removably coupled thereto via a slot 42.

To facilitate the folding of the sleeve assembly 10, a sleeve placket may be arranged on the sleeve 12 and its dimensions selected such that it extends from the lower edge region of the sleeve 12 to a point adjacent the second portion of the inner surface of the sleeve 12.

Figure 6:
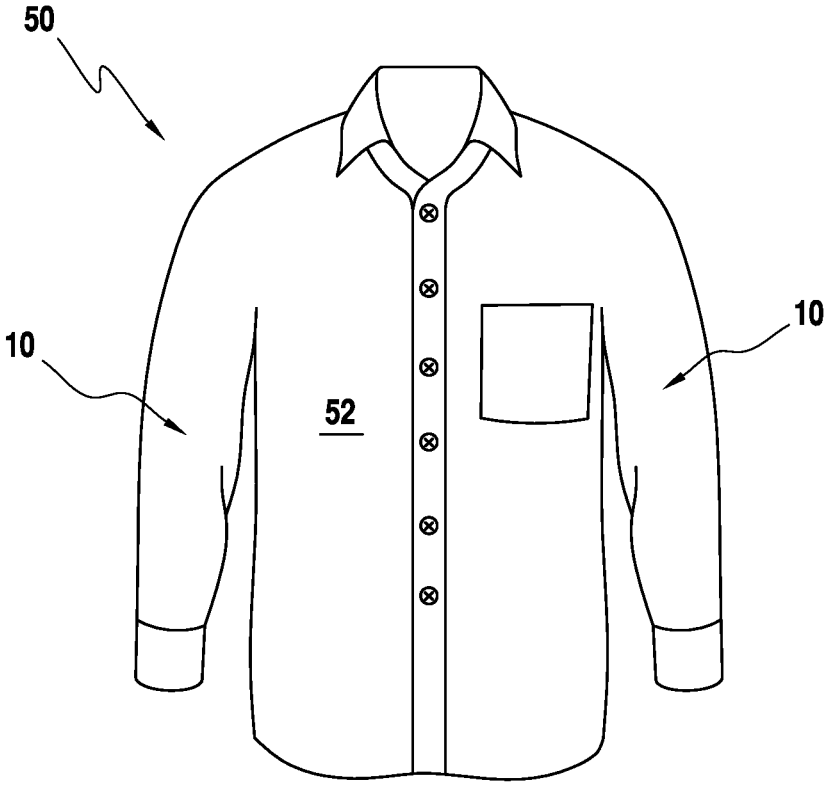
FIG. 6 is a front view of a shirt including two of the sleeve assemblies shown in FIG. 1.

Referring last to FIG. 6, a shirt 50 in accordance with the invention includes a front 52, a back (not shown) and two sleeve assemblies 10 attached to the shirt front and shirt back on opposite sides to form a shirt in a conventional manner. Shirt 50 may be manufactured from pieces including two of the sleeve assemblies 10 manufactured in the manner described above.

The material, color and pattern of the shirt front and shirt back may be as desired, and the material, color and pattern of the components of the sleeve assembly 10 may also be as desired, coordinated to those of the shirt front and/or shirt back or not. There are no limitations as to the design possibilities of the sleeve 12, the cuff 14, the sleeve placket 16, the strap 38, as well as those of the shirt front and shirt back.

While the foregoing description and drawings represent the preferred embodiments of the present invention, it will be understood that various changes and modifications may be made without departing from the scope of the present invention.

What is claimed is:

1. A method for manufacturing a sleeve assembly for a garment, comprising:

connecting a cuff having an inner surface and an outer surface and an upper edge and a lower edge to a lower edge region of a sleeve at a location on said outer surface of the cuff between the upper and lower edges of the cuff to thereby define a cuff extension portion between the location at which the cuff is connected to the lower edge region of the sleeve and the upper edge of the cuff, said cuff extension portion being alongside but not affixed to an inner side of the sleeve assembly when the sleeve assembly is in an unfolded condition, the sleeve assembly being foldable to a first folded condition about the location at which the outer surface of the cuff is connected to the lower edge region; and selecting dimensions of the cuff extension portion such that when the sleeve assembly is folded from the first folded condition to a second folded condition about a location at which the lower edge of the cuff abuts the sleeve, a first portion of an inner surface of the sleeve is placed on an outer side of the sleeve assembly and an outer surface of the cuff at the cuff extension portion is placed between the first portion of the inner surface of the sleeve on the outer side of the sleeve assembly and a portion of an outer surface of the sleeve.

2. The method of claim 1, further comprising configuring the sleeve assembly to be foldable from the second folded condition to a third folded condition about a location at which the cuff extension portion abuts the sleeve to thereby place a second portion of the inner surface of the sleeve on the outer side of the sleeve assembly.

3. The method of claim 2, further comprising:

arranging an attachment device on the second portion of the inner surface of the sleeve;

fixing a strap at one end region to a third portion of the inner surface of the sleeve; and selecting dimensions of the strap to enable the strap to extend around to the attachment device and be removably coupled thereto.

4. The method of claim 3, further comprising:

arranging a sleeve placket on the sleeve;

selecting dimensions of the sleeve placket such that it extends from the lower edge region of the sleeve to a point adjacent the second portion of the inner surface of the sleeve.

5. The method of claim 4, wherein the one end region of the strap is fixed to the third portion of the inner surface of the sleeve by stitching to the portion of the inner surface of the sleeve.

6. A method of manufacturing a shirt, comprising:

affixing together a shirt front, a shirt back, and two sleeve assemblies manufactured by the method of claim 1.

* * * * *